United States Patent [19]

Hathaway

[11] Patent Number: 4,700,939

[45] Date of Patent: Oct. 20, 1987

[54] APPARATUS AND PROCESS FOR SEPARATING AND REMOVING BUNDLES OF SHEETS

[75] Inventor: John M. Hathaway, Green Bay, Wis.

[73] Assignee: Kimberly-Clark Corporation, Neenah, Wis.

[21] Appl. No.: 895,780

[22] Filed: Aug. 12, 1986

[51] Int. Cl.[4] ..... B41L 1/32

[52] U.S. Cl. ..... 270/39; 225/1; 225/3; 225/100; 493/357; 493/412; 493/430; 493/433

[58] Field of Search ..... 270/39–41, 270/47, 52, 52.5, 21.1, 95; 225/1, 3, , 93, 97–98, 100–101, 103–106; 493/357–362, 364, 379–381, 386, 390, 398, 372, 409–414, 424, 429–430, 433

[56] References Cited

U.S. PATENT DOCUMENTS

| | | | |
|---|---|---|---|
| 843,781 | 2/1907 | Wheeler | 270/39 |
| 2,855,833 | 10/1958 | Rugg et al. | 270/95 |
| 3,044,766 | 1/1962 | Banks | 493/433 |
| 3,489,406 | 1/1970 | Nystrand | 493/430 X |
| 3,572,681 | 3/1971 | Nystrand | 270/39 |
| 3,640,251 | 2/1972 | Hutley | 493/412 |
| 4,406,650 | 9/1983 | Felix | 493/433 |
| 4,494,741 | 7/1985 | Fischer et al. | 493/433 |
| 4,508,527 | 4/1985 | Uno et al. | 225/103 |
| 4,618,340 | 10/1986 | Meschi | 493/412 |

FOREIGN PATENT DOCUMENTS

| | | | |
|---|---|---|---|
| 169530 | 4/1906 | Fed. Rep. of Germany | 270/39 |
| 1214983 | 4/1966 | Fed. Rep. of Germany | 493/411 |

*Primary Examiner*—E. H. Eickholt

*Attorney, Agent, or Firm*—Gregory E. Croft; Donald L. Traut; Jeremiah J. Duggan

[57] ABSTRACT

Apparatus and processes for receiving sheets from a sheet stacker, separating them into bundles, and removing the bundles from the discharge area of the sheet stacking apparatus. The apparatus includes a frame, a rotatable receiving means mounted on the frame, means for separating the bundles of sheets being received, and means for rotating the rotatable receiving means. The receiving means may include a plurality of sheet receiving chambers, each chamber having an elevator which may be lowered in the respective chamber. The apparatus also has means for raising each elevator. The separating means accumulates the sheets being received from the sheet stacker while the receiving means is being rotated.

31 Claims, 7 Drawing Figures

APPARATUS AND PROCESS FOR SEPARATING AND REMOVING BUNDLES OF SHEETS

BACKGROUND OF THE INVENTION

This invention relates to apparatus and methods for separating and removing bundles of stacked sheets from the discharge area of sheet stackers and sheet folding and stacking apparatus.

This invention is particularly applicable for use with interfolding of paper sheets in the formation of a stack of interfolded sheets; and the forming of discrete bundles, with each bundle having the same number of sheets.

The interfolding of sheets is well known. U.S. Pat. No. 2,761,677 to Rutkus et al. teaches a rotary interfolder, for forming a stack of interfolded sheets. Similarly U.S. Pat. No. 4,190,241 to Krueger teaches another apparatus for forming a stack of interfolded sheets. In the Rutkus patent the stack of sheets is fed to an elongated chute accumulator. The stack is eventually fed to a stack separating mechanism displaced some distance from the stack forming area which stack forming area is at the discharge of the interfolding apparatus. The Krueger patent teaches the use of an elevator to remove an exact number of C-folded sheets. While the elevator is removing the stack, an accumulator plate continues to accumulate additional sheets until the elevator returns. U.S. Pat. No. 2,675,747 to Greiner et al. teaches a vertically moving accumulator elevator. A cutting separator plate and pusher combination cuts the sheet bonds and pushes the bundle sideways off the conveyor.

It is an object of this invention to provide novel apparatus and processes for defining bundles of exact sheet count in the discharge area of stacking apparatus or apparatus having the dual capability of folding and stacking the sheets.

It is another object of the invention to provide apparatus which is capable of holding a plurality of bundles of stacked sheets, physically separated by a space, for delivery to a bundle discharge area, while the apparatus is continuing to receive sheets in the formation of an additional bundle.

It is a further object to provide rotational apparatus which is capable of receiving a stack of sheets, in formation of a bundle, and rotating the apparatus about an axis therein to deliver the bundle to a bundle discharge area.

SUMMARY OF THE INVENTION

These and other objects are attained in apparatus and processes for receiving a stack of sheets from the discharge area of sheet stacking apparatus, separating the stack into discrete bundles in the discharge area of the sheet stacking apparatus, and removing the bundles of stacked sheets from the discharge area. The apparatus of the invention includes a frame, a rotatable receiving means mounted on the frame and having a plurality of sheet receiving chambers, and separating means, for separating a bundle from the sheets being received, and means for rotating the rotatable receiving means.

The apparatus may further include an elevator in each of the sheet receiving chambers, means for lowering an elevator in the respective one of the chambers when sheets are being received in that chamber, and means for raising each of the elevators as the rotatable receiving means is rotated through a complete 360 degree revolution. Preferably a cam is mounted on the frame and a plurality of cam followers connect the several elevators to the cam. A preferred means for lowering the selected one of the elevators, at an appropriate point in the process, is a pushing means, such as a control rod connected to an air cylinder, for pushing on the corresponding one of the cam followers.

In the preferred apparatus of the invention, the pushing means, the cam, and the cam followers are so designed that the pushing means pushes the appropriate one of the cam followers, lowering it in the cam channel, and thereby lowering the corresponding one of the elevators, such that the cam and the cam follower initially hold the elevator in the lowered disposition upon rotation of the rotatable receiving means.

It is desired in the preferred embodiments of the invention to include means for upwardly biasing the selected one of the elevators which is receiving, or about to receive sheets from the discharge area of the sheet stacker. The upward biasing means tends to push the elevator outwardly of the receiving means.

The apparatus for raising the elevators on rotation of the rotatable receiving means is preferred to be embodied in the cam and the cam followers. The cam may be a pair of cams on opposite ends of the rotatable receiving means, with a pair of cam followers attached to the respective one of the elevators and extending between the two cams.

The separating means is preferred to be a separator disposed for interposition between the sheet stacking apparatus and the rotatable receiving means.

Typically the apparatus includes a retainer positioned adjacent the rotatable receiving means, for retaining the bundles in the respective ones of the chambers for an angular portion of the rotation of the receiving means. The retainer has a leading edge closer to the separating means and a trailing edge more remote from the separating means. Adjacent the trailing edge of the retainer is means for receiving a bundle from each chamber as the chamber is rotated to a position where it can transfer the bundle to the receiving means.

The separating means, in addition to the separator itself, may further include a plurality of sheet control members mounted for being disposed into contact with selected sheets at the discharge area of the stacking apparatus. In some embodiments, at least one of the sheet control members is mounted on the rotatable receiving means. Further in some embodiments at least one of the sheet control members is mounted on the frame. In certain embodiments at least one of the sheet control members is able to urge a sheet against the separator when the separator is interposed between the receiving means and the sheet stacking apparatus.

The invention is also seen to be embodied in a process for separating bundles of sheets from a stack in the discharge area of sheet stacking apparatus and removing the bundles from the discharge area. The process includes the step of receiving a plurality of sheets from a sheet stacking apparatus, thereby creating a stack in a first sheet receiving chamber, on a rotatable receiving means having a plurality of sheet receiving chambers. A subsequent step of inserting separator means between the stacking apparatus and the stack defines a bundle of sheets. Rotating the rotatable receiving means removes the defined bundle from the immediate discharge area of the sheet stacker.

Preferred embodiments of the process are performed with apparatus wherein each chamber has an elevator in it, the stack of sheets being received on the respective ones of the elevators upon rotation of the respective ones of the elevators into the discharge area of the sheet stacker.

The rotating of the receiving means comprises rotating it through a portion of a circle to thereby remove a first sheet receiving chamber from the discharge area and present a second one of the chambers into the discharge area for receiving sheets on a second elevator in that second chamber. In preferred embodiments the process further comprises the steps of lowering the respective ones of the elevators while they are receiving sheets from the sheet stacker, and receiving and accumulating sheets from the stacking apparatus onto the separator means during rotation of the rotatable receiving means, while the receiving means is rotating one chamber away from the sheet receiving area and is rotating another chamber into a sheet receiving relationship. When the incoming chamber has reached the proper sheet receiving position in the sheet receiving area, the separator means is withdrawn, thereby depositing the sheets onto the elevator of the incoming chamber.

In the preferred embodiments, the process includes the step of raising each elevator as the receiving means is intermittently rotated through an entire circle. The elevators are desirably raised through the use of a cam, or a pair of cams, and connecting cam followers, which connect the cam mechanism and the elevators. Each of the elevators is lowered while it is receiving sheets from the sheet stacker by means of pushing on the respective cam follower, thus lowering the cam follower in the cam, such that the cam follower is properly positioned in the cam for the subsequent rotation of the receiving means.

While an elevator is in the sheet receiving position in the discharge area of the sheet stackers it is desirable to push outwardly of the receiving means on the elevator mechanism, whether on the elevator itself, on the cam follower, or on linkage between the elevator and the cam follower.

The process may further include restraining the bundles in their respective chambers to prevent the bundles falling out of the chambers until they are delivered to a removal means, where they are received, by the removal means, from the chamber.

In some embodiments the process includes, when an appropriate number of sheets has been received, contacting the stack with a plurality of sheet control members for influencing which of the sheets leave the discharge area with the bundle and which of the sheets remain in the discharge area on the separator means.

DETAILED DESCRIPTION OF THE ILLUSTRATED EMBODIMENTS

Figure 1:
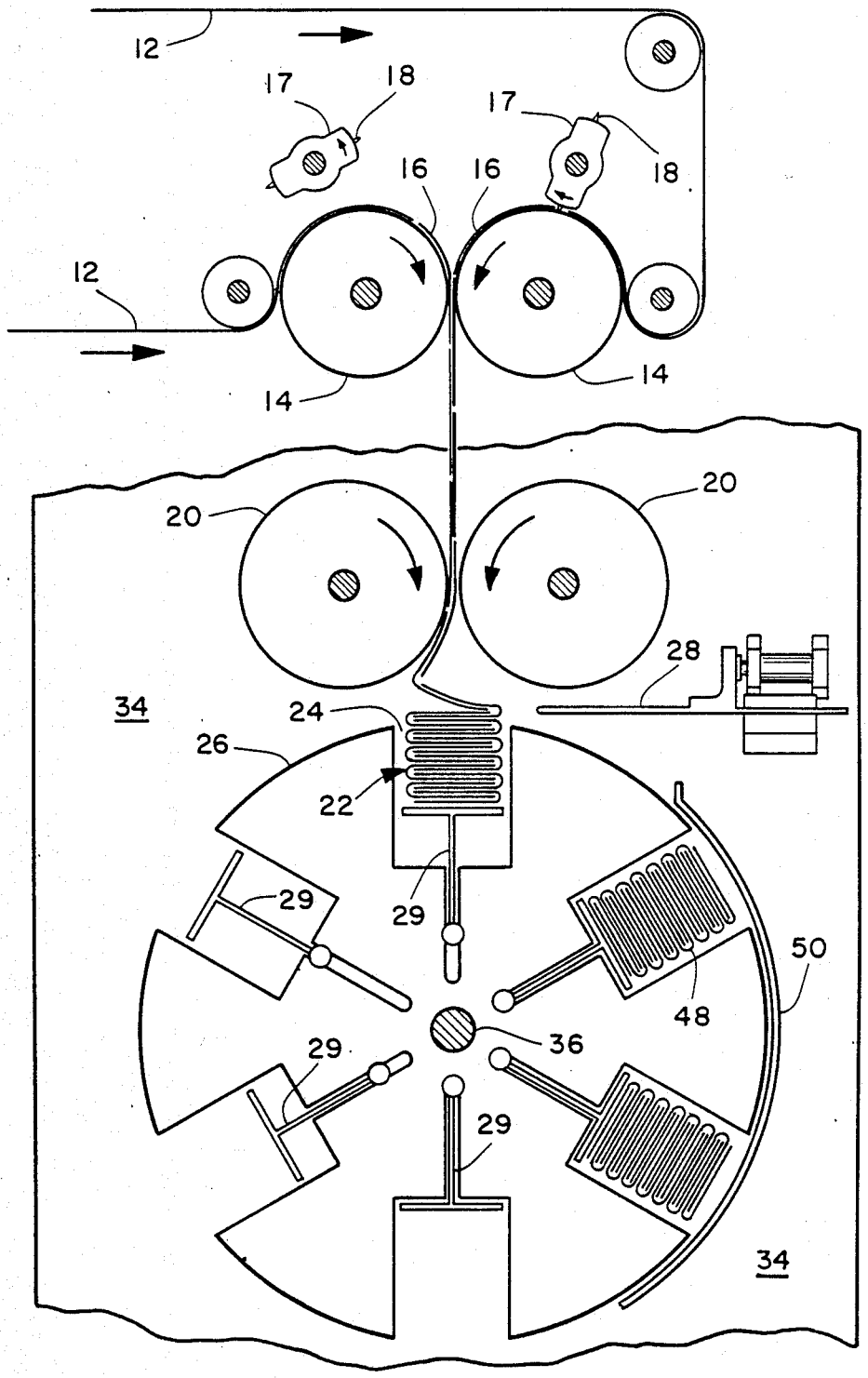
FIG. 1 shows apparatus of the invention for receiving sheets, and separating and removing bundles of stacked sheets from a discharge area of illustrated sheet cutting, folding and stacking apparatus.

Referring now to FIG. 1, two webs of paper 12 are fed over a series of guide cylinders onto anvil cylinders 14 where they are cut into individual sheets 16 by cutters 17, having knives 18 mounted therein. The individual sheets preferably have small uncut areas between them at places where cutter knives 18 are discontinuous. These uncut areas provide low strength bonds for the handling of the thus sheeted web through the balance of the process. The timing of the cutters is such that the locations of the cuts on the webs 12 alternate, so that each cut on one web is adjacent an uncut area on the other web, as is conventionally practiced in the cutting and folding of interfolded sheets. The two webs are joined together at the line of convergence of anvil cylinders 14. The joined webs are fed to folding cylinders 20 where they are folded in a conventional manner and formed into an interfolded stack 22. Stack 22 is received in chamber 24 in a rotatable receiving cylinder 26 which has a plurality of stack receiving chambers 24 therein.

Figure 2:
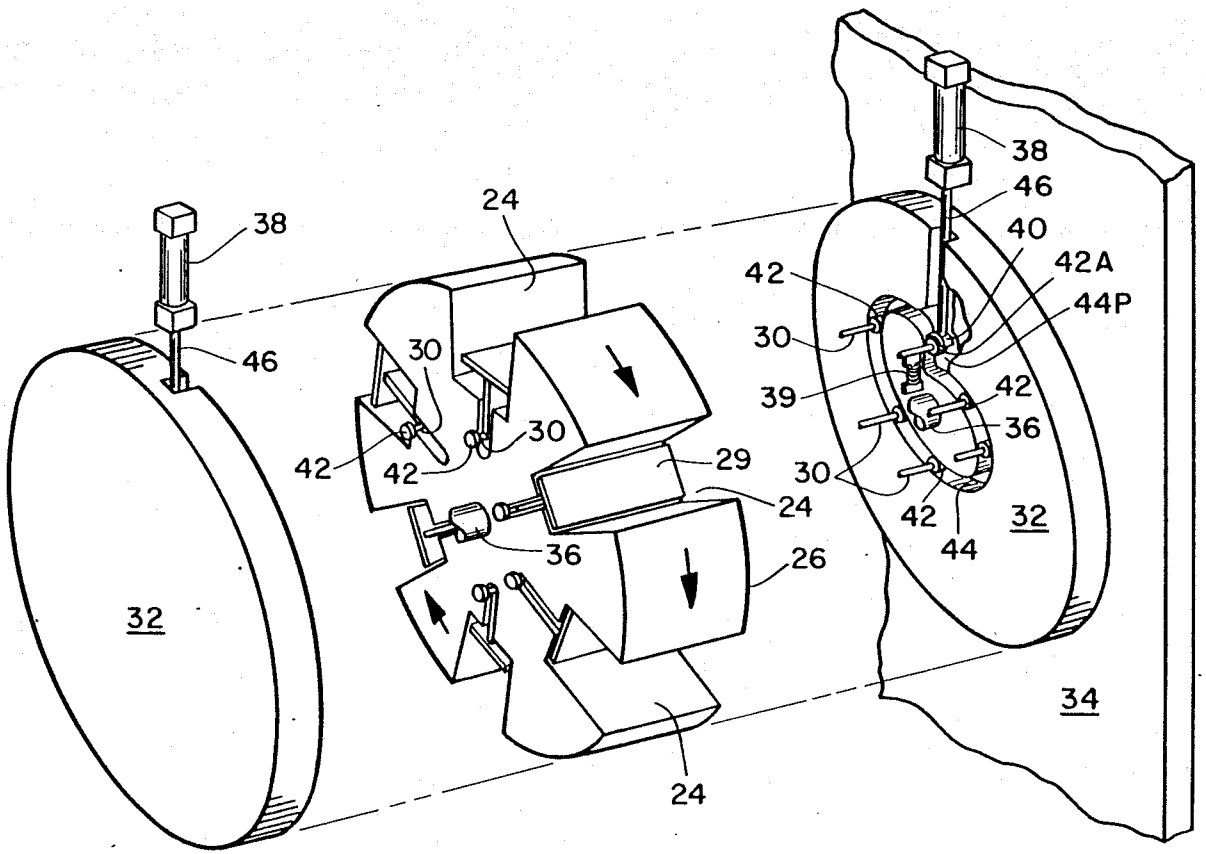
FIG. 2 is an exploded partial pictorial view of the receiving and removing apparatus of the invention.

As seen in FIG. 2, each chamber 24 has an elevator 29 which is connected by the appropriate cam follower 30 to cam 32 mounted to the frame 34. Rotatable receiving cylinder 26 is mounted by a shaft 36, and slidably through cam 32, to frame 34.

Shock dampened spring 39 is mounted on cam 32 adjacent the upwardly directed channel portion 44P in cam channel 44, which is in cam 32.

As the interfolded sheets are delivered from folding and stacking cylinders 20 to the top of the stack 22, shaft 46 of cylinder 38 pushes downwardly, through foot 40, on the corresponding cam follower end 42A, against, and overcoming, the resistance of spring 39, such that elevator 29 is lowered in chamber 24 resulting in the interfolded sheets 16 being received on the top of stack 22 at an approximately consistent height. Follower end 42 is part of follower 30.

Figure 3:
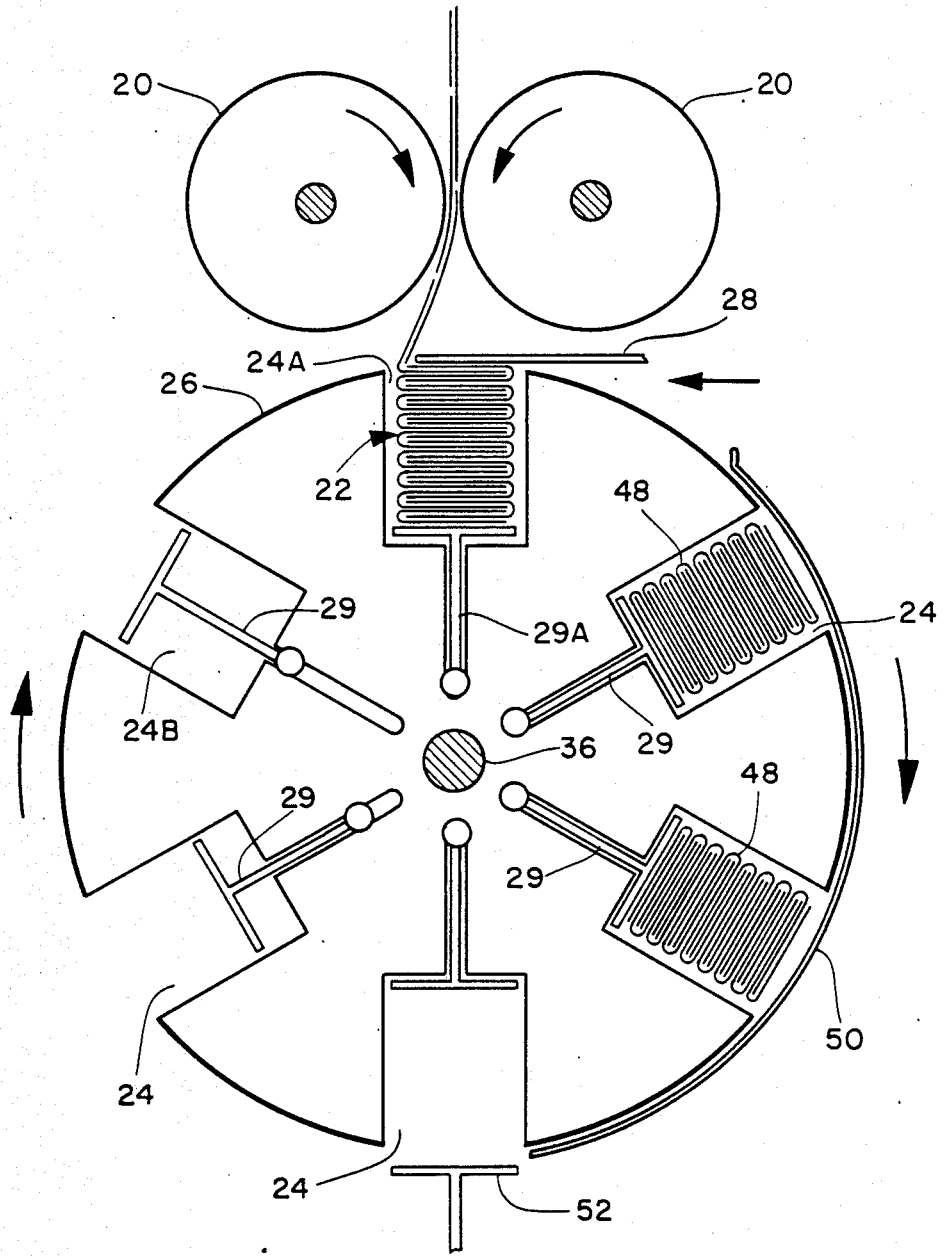
FIGS. 3, 4 and 5 are side elevations showing the receiving, separating and removing portions of the apparatus of FIG. 1, as it proceeds through the various stages of the process.

When the desired number of sheets has been received in stack 22, separator 28, which is mounted on frame 34, is inserted into the stack as seen in FIG. 3. The folding and stacking cylinders continue to discharge the folded sheets, and stack them on separator 28 as seen in FIG. 4, while the receiving cylinder 26 rotates approximately 60 degrees in order to take the filled chamber 24A away from the discharge area and bring an empty chamber 24B into the discharge area to receive the folded and stacked sheets.

Figure 4:
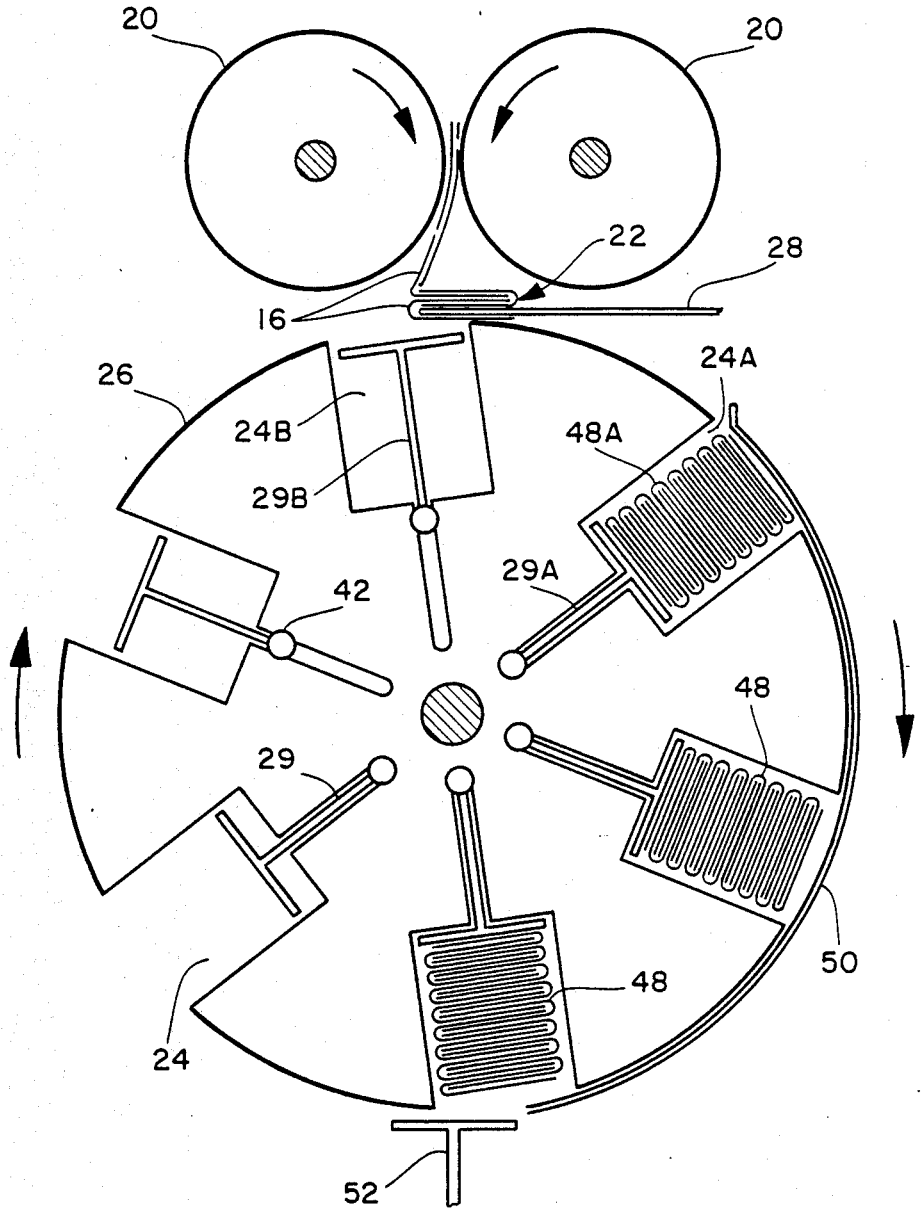
Figure 5:
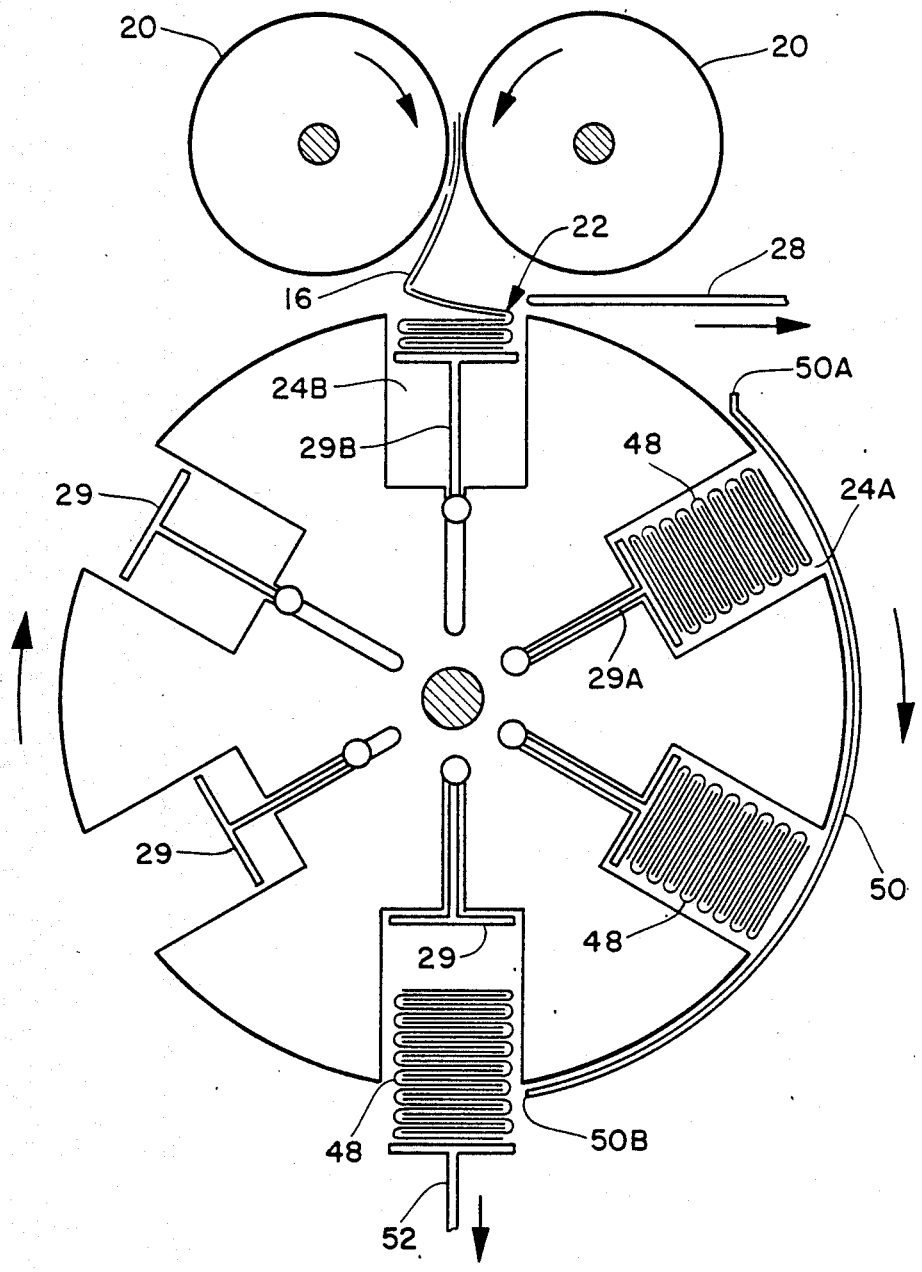

Referring now to FIG. 4, it is seen that chamber 24A has been rotated from the discharge area and chamber 24B has been rotated toward the discharge. As the rotation is completed, and chamber 24B is in a position to receive sheets from the discharge of the folding and stacking cylinders 20, separator 28 is withdrawn from the stack, as seen in FIG. 5, whereby the partially formed stack of sheets on separator plate 28 is effectively transferred to elevator 29B. As the chambers 24 receive the appropriate number of sheets and are rotated away from the discharge area, the bundles are retained in the chambers by a retaining shield 50 which is mounted on frame 34 and positioned adjacent the surface of cylinder 26, in an arc between the discharge area and a bundle take-away area. Retainer 50 has a leading edge 50A positioned closer to the discharge area and a trailing edge 50B more remote from the discharge area of the folding and stacking cylinders 20. As the folding and stacking cylinders 20 continue to deliver interfolded stacks of sheets to chambers 24, receiving cylinder 26 rotates so that the filled cylinders are removed from the discharge area and empty cylinders are presented for filling. Through this repeated rotation, the filled cylinders rotate through the arc covered by retainer 50. As they emerge from the trailing edge 50B, take-away elevator 52 receives the bundles 48 and takes them away as seen in FIG. 5.

Cam channel 44 is so designed that it directs the cam followers upwardly after the delivery of a bundle 48 from the chamber 24 onto take-away elevator 52. Thus, as an elevator rotates with the rotating receiving cylinder 26 from the 6 o'clock position, where it discharges its bundle to elevator 52, to the 12 o'clock position where it receives a new bundle, the elevator is raised. The stages of raising of the elevator are seen particularly in FIGS. 1, 3, 4 and 5. The path of cam channel 44, as seen in FIG. 2 is consistent with the raising of the elevators.

As a chamber 24 reaches the stack receiving position, the corresponding cam follower 30 arrives over shock absorbing spring 39, and the end 42 of that cam follower is engaged by foot 40 on rod 46 of cylinder 38. As the sheets are received, the elevator is moved downwardly in order to maintain a consistent height for the locus of receiving sheets. The elevator is moved downwardly by rod 46 pushing down, through foot 40, on follower end 42, overcoming the resistance of spring 39. Follower end 42 travels downwardly in portion 44P of cam channel 44. The appropriate number of sheets is received by the time follower end 42 reaches the lower limit of its downward travel. At the lower limit of downward travel of follower end 42, elevator 29 is illustrated as having reached the bottom of chamber 24, as seen in FIG. 3. When follower end 42 has reached the lower limit, cylinder 26 rotates about 60 degrees, to take away the filled chamber, and present the next chamber for filling.

As cylinder 26 rotates, cam follower 30 moves along cam channel 44 in a clockwise direction as viewed in Figure 2, and shown by the arrows. With the rotation of receiving cylinder 26, rod 46 and foot 40 are withdrawn from channel portion 44P and spring 39 extends, so that the next cam follower comes into a position between spring 39 and foot 40. With the rotation of receiving cylinder 26, bundles 48 are delivered to take-away elevator 52. Each elevator 29 is raised back to the elevated position shown adjacent the sheet discharge area in FIG. 4 upon completion of an entire revolution of receiving cylinder 26. Thus the height of the elevator is highest as it begins to receive the folded sheets from cylinders 20. The elevator is lowered to its lowest position by rod 46 of cylinder 38 as it finishes receiving a bundle 48 of sheets from the folding cylinders 20, and as separator 28 is inserted into the stack. The elevator remains at its lowest position, as the cylinder is rotated, until after it has discharged its bundle to take-away elevator 52. After discharge of the bundle 48, the elevator 29 gradually rises in the chamber due to its cam follower following cam channel 44, until it reaches its upper position again as it is rotated into position to receive another bundle.

In the above description, it is assumed that the appropriate sheet count for a given bundle is reached virtually simultaneously with elevator 29 reaching its lowest position, such that the interposition of separator 28 is essentially simultaneous with rotation of cylinder 26. The apparatus of the invention can, however, be used for receiving a plurality of sizes of bundles in chambers 24. The chambers and elevators are sized for receiving the largest anticipated bundle size. In operating with smaller size bundles, the elevators 29 may not have reached the lowest position by the time the proper sheet count is reached and the separator interposed. It is important that cam follower end 42 be able to follow cam channel 44 as it moves out from under foot 40 upon the initial part of rotation of cylinder 26. Thus rod 46 may push cam follower end 42, and consequently elevator 29, to its lowest position after interposition of separator 28.

Also, the description herein has concentrated on describing one cam mechanism, namely the one on the right side of exploded FIG. 2, and having its internal workings illustrated thereby. The apparatus of the invention preferably, though not necessarily, has two such cam mechanisms, one being the mirror image of the other. A second such cam mechanism is seen on the left side of FIG. 2, including the cam 32, with internal workings not visible, followers 30, including follower ends 42, cylinder 38 and cylinder rod 46.

Figure 7:
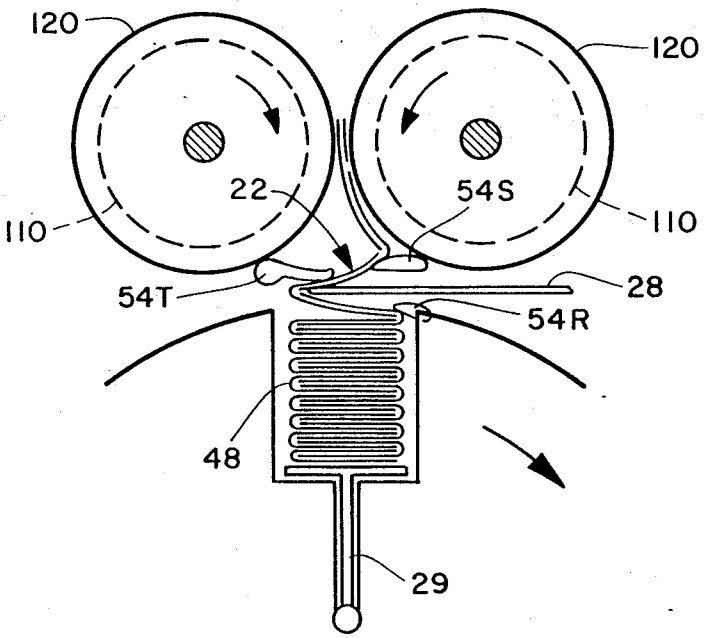
FIGS. 6 and 7 are partial side elevations showing alternate embodiments of the receiving, separating and removing apparatus, wherein a plurality of sheet control members are functionally disposed into the forming stack to assist in the separation process.
Figure 6:
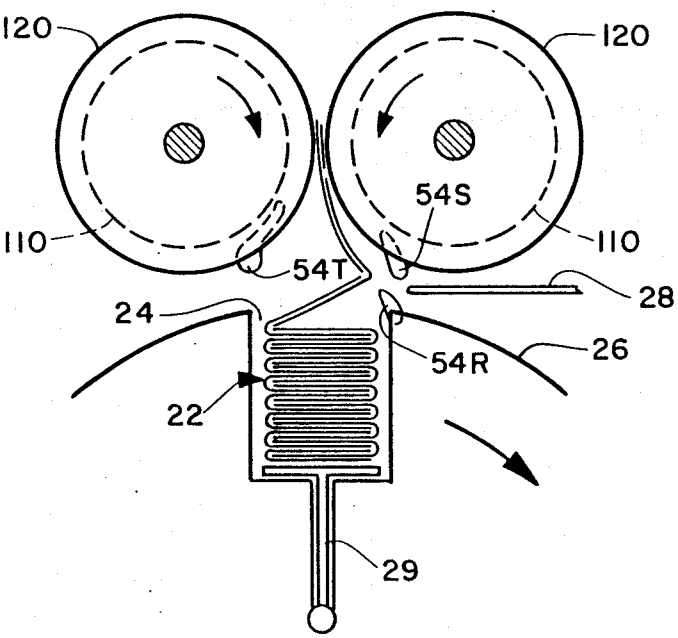

In an alternate embodiment of the invention, a plurality of sheet controlling fingers 54 are positioned in the sheet discharge area. Finger 54R is mounted on cylinder 26 and rotates downwardly when the exact sheet count is reached to ensure that all sheets are held in the chamber and rotated with the receiving cylinder 26. Finger 54S then rotates downwardly to create a space between fingers 54R and 54S to assist in preserving a channel for the insertion of separator 28. See FIG. 7. After separator 28 has been inserted into the stack, finger 54T rotates downwardly and holds the sheets against separator 28 as shown in FIG. 7. As cylinder 26 rotates in the direction shown in FIGS. 6 and 7, finger 54R, which is mounted on roll 26 goes with chamber 24. Fingers 54S and 54T may be withdrawn from the stack to the positions shown in FIG. 6, inside grooves 110 in cylinders 120, after rotation of the filled chamber away from the discharge area. Cylinders 120 correspond to cylinders 20 in FIGS. 1 and 3–5. All of the fingers and the separator plate are out of the stack when sheets are being received on an elevator 29.

Thus it is seen that the invention provides novel apparatus and processes for defining bundles of exact sheet count in the discharge area of stacking apparatus or apparatus having the dual capability of folding and stacking the sheets.

The invention further provides novel apparatus which is capable of holding a plurality of bundles of stacked sheets, physically separated by a space, for delivery to a bundle discharge area, while the apparatus is continuing to receive sheets in the formation of an additional bundle.

Still further, the invention provides novel rotational apparatus which is capable of receiving a stack of sheets from the discharge area of sheet stacking apparatus, separating the stack in formation of discrete bundles, and rotating the apparatus, about an axis therein, to remove the bundles from the sheet discharge area. The invention may be applied to any number of different types of sheets, different types of sheet folding, interfolding sheets, and a variety of sheet surface characteristics.

Having thus described the invention, what is claimed is:

1. Apparatus for receiving sheets, and separating and removing of bundles of stacked sheets from the discharge area of sheet stacking apparatus, said separating and removing apparatus comprising:
(a) a frame;
(b) rotatable receiving means mounted on said frame and having a plurality of sheet receiving chambers;
(c) means, adjacent said rotatable receiving means, for separating one said bundle from sheets being received; and
(d) means for rotating said rotatable receiving means.

2. Apparatus as in claim 1 and further including an elevator in each said chamber, means for lowering a respective one of said elevators in the respective one of said chambers when sheets are being received in said one chamber, and means for raising each said elevator as said rotatable receiving means is rotated through a complete revolution.

3. Apparatus as in claim 2 and including a cam mounted on said frame and a plurality of cam followers connecting said elevators to said cam.

4. Apparatus as in claim 3 wherein said means for lowering a selected one of said elevators in a respective one of said chambers comprises pushing means for pushing on the corresponding one of said cam followers.

5. Apparatus as in claim 4 and including means for upwardly biasing said selected one of said elevators, tending to push said elevator outwardly of said rotatable receiving means.

6. Apparatus as in claim 4, said pushing means, said cam, and said cam followers being so designed that said pushing means may push one said cam follower, lowering said one cam follower in said cam, thereby lowering the corresponding one of said elevators, said cam and said one cam follower initially holding said elevator in said lowered disposition on rotation of said rotatable receiving means.

7. Apparatus as in claim 5, said pushing means, said cam, and said cam followers being so designed that said pushing means may push one said cam follower, lowering said one cam follower in said cam, thereby lowering the corresponding one of said elevators, said cam and said one cam follower initially holding said elevator in said lowered disposition on rotation of said rotatable receiving means.

8. Apparatus as in claim 3, said means for raising said elevators comprising said cam and said cam followers.

9. Apparatus as in claim 2, said separating means comprising a separator disposed for interposition between said sheet stacking apparatus and said receiving means.

10. Apparatus as in claim 4, said separating means comprising a separator disposed for interposition between said sheet stacking apparatus and said receiving means.

11. Apparatus as in claim 5, said separating means comprising a separator disposed for interposition between said sheet stacking apparatus and said receiving means.

12. Apparatus as in claim 8, said separating means comprising a separator disposed for interposition between said sheet stacking apparatus and said receiving means.

13. Apparatus as in claim 1, 4, 5, 7 or 9 and including retainer means disposed adjacent said rotatable receiving means for retaining said bundles in the respective ones of said chambers.

14. Apparatus as in claim 13, said retainer means having a leading edge closer to said separating means and a trailing edge more remote from said separating means, and including means, adjacent said trailing edge, for receiving a bundle from one said chamber.

15. Apparatus as in claim 2, and including retainer means disposed adjacent said rotatable receiving means for retaining said bundles in the respective ones of said chambers.

16. Apparatus as in claim 15, said retainer means having a leading edge closer to said separating means and a trailing edge more remote from said separating means, and including means, adjacent said trailing edge, for receiving a bundle from one said chamber.

17. Apparatus as in claim 9 wherein said separating means further includes a plurality of sheet control members mounted for being disposed into contact with selected sheets at the discharge area of said stacking apparatus.

18. Apparatus as in claim 17 wherein at least one of said sheet control members is mounted on said rotatable receiving means.

19. Apparatus as in claim 17 wherein at least one of said sheet control members is mounted on said frame.

20. Apparatus as in claim 17 wherein at least one of said sheet control members can urge a sheet against said separator when said separator is interposed between said receiving means and said sheet stacking apparatus.

21. A process for receiving sheets, and separating and removing bundles of sheets from the discharge area of sheet stacking apparatus, said process comprising:
(a) receiving a plurality of sheets, from a sheet stacking apparatus, and thereby creating a stack in a first sheet receiving chamber, on a rotatable receiving means having a plurality of sheet-receiving chambers;
(b) interposing separator means between said stacking apparatus and said stack, thereby defining a bundle of said sheets from said stack; and
(c) rotating said rotatable receiving means.

22. A process as in claim 21, each said chamber having an elevator therein, said stack of sheets being received on the respective one of said elevators, said rotating comprising rotating said receiving means through a portion of a circle and thereby removing said first sheet receiving chamber from said discharge area, and presenting a second one of said chambers into said discharge area for receiving sheets on a second elevator thereof, said process comprising, further, the steps of:
(d) lowering the respective one of said elevators while receiving sheets thereon;
(e) receiving sheets from said stacking apparatus onto said separator means during rotation of said rotatable receiving means; and
(f) withdrawing said separator means after rotating said receiving means, thereby depositing said sheets onto the respective one of said elevators.

23. A process as in claim 22 and including the step of raising each said elevator as said receiving means is intermittently rotated through an entire circle.

24. A process as in claim 23 whereby said elevators are raised through the use of a cam and cam followers.

25. A process as in claim 24 wherein said elevators are lowered during receiving of said sheets by means of pushing on respective one of said cam followers.

26. A process as in claim 24 and including pushing said respective cam follower to a position for further following of said cam, by said cam follower, on further rotation of said receiving means.

27. A process as in claim 25 and including pushing outwardly of said receiving means, on said elevator.

28. A process as in claim 22 and including restraining said bundles in said chambers to prevent said bundles from falling out of said chambers.

29. A process as in claim 22 or 28 and including the step of delivering each said bundle to a removal means, for conveying said bundles away.

30. A process as in claim 22 wherein said one elevator is lowered by a pusher pushing on a cam follower connected to said one elevator, thereby extending said pusher, and wherein said pusher is retracted during rotation of said rotatable receiving means.

31. A process as in claim 22 and including, when an appropriate number of sheets has been received in one said bundle, contacting said stack with a plurality of sheet control members for influencing which of said sheets leaves said discharge area with said one bundle and which of said sheets remains in said discharge area, on said separator means, for delivery onto a subsequent one of said elevators.

* * * * *